US005254281A

United States Patent [19]

Pichardo et al.

[11] Patent Number: 5,254,281

[45] Date of Patent: Oct. 19, 1993

[54] SOAP BARS WITH POLYHYDROXY FATTY ACID AMIDES

[75] Inventors: Francisco A. Pichardo, Cincinnati; James E. Kaleta, Fairfield, both of Ohio

[73] Assignee: The Procter & Gamble Company, Cincinnati, Ohio

[21] Appl. No.: 818,321

[22] Filed: Jan. 8, 1992

Related U.S. Application Data

[63] Continuation of Ser. No. 645,361, Jan. 29, 1991, abandoned.

[51] Int. Cl.[5] ..... C11D 9/00

[52] U.S. Cl. ..... 252/108; 252/117; 252/118

[58] Field of Search ..... 252/117, 121, 118, 108

[56] References Cited

U.S. PATENT DOCUMENTS

| | | | |
|---|---|---|---|
| 2,653,932 | 9/1953 | Schwartz | 260/211 |
| 2,662,073 | 12/1953 | Mehltretter et al. | 260/102 |
| 2,703,798 | 3/1955 | Schwartz | 260/211 |
| 2,717,894 | 9/1955 | Schwartz | 260/211 |
| 2,954,347 | 9/1960 | St. John et al. | 252/109 |
| 2,965,576 | 12/1960 | Wilson | 252/529 |

(List continued on next page.)

FOREIGN PATENT DOCUMENTS

| | | |
|---|---|---|
| 206283 | 6/1956 | Australia . |
| 0220676 | 5/1987 | European Pat. Off. . |
| 0222525 | 5/1987 | European Pat. Off. . |
| 0285768 | 10/1988 | European Pat. Off. . |
| 13746 | 9/1957 | Fed. Rep. of Germany . |
| 23346 | 6/1962 | Fed. Rep. of Germany . |
| 1261861 | 2/1968 | Fed. Rep. of Germany . |
| 2226872 | 12/1973 | Fed. Rep. of Germany . |
| 1360018 | 4/1964 | France . |
| 1580491 | 9/1969 | France . |
| 2657611 | 2/1991 | France . |
| 53839 | 2/1967 | German Democratic Rep. . |
| 3-112904-A | 5/1991 | Japan . |
| WO83/04412 | 12/1983 | PCT Int'l Appl. . |
| 420518 | 11/1934 | United Kingdom . |
| 745036 | 2/1956 | United Kingdom . |
| A-771423 | 4/1957 | United Kingdom . |
| 771423 | 4/1957 | United Kingdom . |
| 809060 | 12/1960 | United Kingdom . |

OTHER PUBLICATIONS

"The Thermotropic Liquid-Crystalline Properties of Some Straight Chain Carbohydrate Amphiphiles", *Liquid Crystals*, 1988, vol. 3, No. 11, pp. 1569-1581, Goodby, Marcus, Chin, Finn.

"Molecular and Crystal Structure of a Nonionic Detergent: Nonanoyl-N-methylglucamide", *J. Chem. Soc. Chem. Commun.*, 1986, pp. 1573-1574, Muller-Fahrnow, Zabel, Steifa, Hilgenfeld.

"N-D-Gluco-N-methylalkanamide Compounds, a New Class of non-Ionic Detergents For Membrane Biochemistry", *Biochem. J.* (1982), vol. 207, pp. 363-366, Hildreth.

Relative Stabilities of d-Glucose-Amine Derivatives, Mohammad and Olcott, JACS, Apr. 1947, p. 969.

[23] 1-Amino-1-deoxy-D-glucitol, Long and Bollenback, Meth. Carbohyd. Chem., vol. 2, (1963), pp. 79-83.

The Reaction of Glucose with Some Amines, Mitts and Hixon, JACS, vol. 66, (1944), pp. 483-486.

Synthesis of $^{14}C$-Labeled N-Methylglucamine, Heeg et al, Can. J. of Pharmaceutical Sciences, vol. 10, No. 3 (1975), pp. 75-76.

H. Kelkenberg, Tenside Surfactants Detergents 25 (1988) pp. 8-13.

*Primary Examiner*—Paul Lieberman
*Assistant Examiner*—Necholus Ogden
*Attorney, Agent, or Firm*—Jerry J. Yetter

[57] ABSTRACT

Bar soaps containing polyhydroxy fatty acid amides exhibit good "smear" qualities, desirable hardness and good lather properties. The bars also have a decreased tendency to crack. Bars comprising soap and materials such as $C_{12}$-$C_{18}$ N-methyl glucamide are provided.

2 Claims, No Drawings

U.S. PATENT DOCUMENTS

| | | | |
|---|---|---|---|
| 2,982,737 | 5/1961 | Boettner et al. | 252/152 |
| 2,991,296 | 7/1961 | Scherr | 260/404 |
| 3,043,779 | 7/1962 | Parke | 252/117 |
| 3,128,287 | 4/1964 | Berg | 260/346.8 |
| 3,308,067 | 3/1967 | Diehl | 252/161 |
| 3,312,626 | 4/1967 | Hooker | 252/152 |
| 3,312,627 | 4/1967 | Hooker | 252/152 |
| 3,455,839 | 7/1969 | Rauner | 252/321 |
| 3,576,749 | 4/1971 | Megson et al. | 252/132 |
| 3,635,830 | 1/1972 | Lamberti et al. | 252/152 |
| 3,637,495 | 1/1972 | Eckert et al. | 252/8.8 |
| 3,654,166 | 4/1972 | Eckert et al. | 252/117 |
| 3,704,228 | 11/1972 | Eckert | 252/117 |
| 3,920,586 | 11/1975 | Bonaparte et al. | 252/531 |
| 3,929,678 | 12/1975 | Laughlin et al. | 252/526 |
| 3,985,669 | 10/1976 | Krummel et al. | 252/116 |
| 3,988,255 | 10/1976 | Seiden | 252/117 |
| 4,000,093 | 12/1976 | Nicol et al. | 252/550 |
| 4,021,539 | 5/1977 | Möller et al. | 424/73 |
| 4,094,808 | 6/1978 | Stewart et al. | 252/186 |
| 4,129,511 | 12/1978 | Ogoshi et al. | 252/140 |
| 4,265,779 | 5/1981 | Gandolfo et al. | 252/135 |
| 4,268,262 | 5/1981 | Bechstedt | 8/137 |
| 4,268,406 | 5/1981 | O'Brien et al. | 252/105 |
| 4,292,212 | 9/1981 | Melby | 252/547 |
| 4,435,317 | 3/1984 | Gerritsen et al. | 252/547 |
| 4,483,780 | 11/1984 | Llenado | 252/135 |
| 4,483,781 | 11/1984 | Hartman | 252/174.12 |
| 4,540,821 | 9/1985 | Larkin et al. | 564/473 |
| 4,565,647 | 1/1986 | Llenado | 252/354 |
| 4,605,509 | 8/1986 | Corkill et al. | 252/131 |
| 4,663,071 | 5/1987 | Bush et al. | 252/174.19 |
| 4,664,839 | 5/1987 | Rieck | 252/175 |
| 4,689,167 | 8/1987 | Collins et al. | 252/95 |
| 4,704,224 | 11/1987 | Saud | 252/132 |
| 4,790,856 | 12/1988 | Wixon | 8/137 |
| 4,843,154 | 6/1989 | Klein et al. | 536/4.1 |
| 5,009,814 | 4/1923 | Kelkenberg et al. | 252/528 |

SOAP BARS WITH POLYHYDROXY FATTY ACID AMIDES

This is a continuation of application Ser. No. 645,361 filed on Jan. 29, 1991, now abandoned.

FIELD OF THE INVENTION

The present invention relates to soap bars, especially soap bars designed for personal hygiene and/or cosmetic use, which contain polyhydroxy fatty acid amides.

BACKGROUND OF THE INVENTION

The formulation of soap bars (i.e., "toilet bars") for personal cleansing has been a matter of standard practice for many, many years. However, and irrespective of historical usage, there are still several problems associated with soap bars. As is well known to formulators and users, soap bars tend to undesirably form a type of soap/water gel, especially when stored in-use under circumstances where they can be contacted by water, e.g., in soap dishes, and the like, typically used in home lavatories. The bar then softens and smears. Besides being unsightly, this leads to wastage of the bar, in-use. One method of decreasing bar smear is by reducing the water content of the soap bar. However, reducedwater content soap bars tend to crack on storage. In addition, soap bars for personal hygiene use desirably have high lathering properties. Inappropriately adjusting the water content of otherwise standard soap bars to reduce wastage can impact negatively on lather properties. Another way to decrease soap bar wastage is to employ highly saturated (i.e., low Iodine Value) fatty acid feedstocks in the soap. However, low Iodine Value soaps lather poorly, yield bars which crack on storage and can have an undesirable gritty feel. Thus, there is a continuing search for means whereby wastage of soap bars can be diminished so that the consumer is not left with the impression that soap bar usage is uneconomical, yet without otherwise negatively affecting lather properties, cleansing performance and other desirable aspects of the bars.

It is an object of the present invention to provide soap bars having low smear, appropriate bar hardness with associated decreased wastage, adequate, or even improved, lather properties, and low tendency to crack on storage.

The present invention employs polyhydroxy fatty acid amides in combination with water-soluble fatty acid soaps, in the manner described hereinafter, to secure the above-mentioned objects. The addition of the polyhydroxy fatty acid amides reduces the tendency of the soap bar to gel, thereby resulting in less smear and a longer-lasting bar. Furthermore, the polyhydroxy fatty acid amides boost lather and reduce bar cracking. These and other objects are secured by the invention herein, as will be seen from the following disclosures.

BACKGROUND ART

U.S. Pat. No. 3,312,627, issued Apr. 4, 1967 to D. T. Hooker, addresses the problems of excessive toilet bar wastage, excessive solubility or softening when the bar is wetted, etc. Hooker describes bars which contain lithium soaps of certain fatty acids, which he considers to be unique in the practice of his invention (column 8, line 20). More broadly, Hooker also describes nonionic surfactants of various types, and also nonionic lathering components which can include polyhydroxyamides of the formula $RC(O)NR^1(R^2)$ wherein RC(O) contains from about 10 to about 14 carbon atoms, and $R_1$ and $R_2$ each are H or $C_1$–$C_6$ alkyl groups, said alkyl groups containing a total number of carbon atoms of from 2 to about 7 and a total number of substituent hydroxyl groups of from 2 to about 6; column 4, line 11–28. Among his lathering components, Hooker mentions stearoyl N-methyl glucamide and lauroyl N-methyl glucamide. See also, U.S. Pat. No. 3,312,626, also issued Apr. 4, 1967 to D. T. Hooker.

The following references may be of assistance to the formulator in the synthesis of the polyhydroxy fatty acid amide surfactants used herein: U.S. Pat. Nos. 2,016,962; 1,985,424; 2,703,798; 2,993,887; EP-A 285,768; see also H. Kelkenberg in Tenside Surfactants Detergents 25 (1988) 8–13; also, Biochem J., 1982, Vol. 207, pp 363–366.

A variety of polyhydroxy fatty acid amides have been described in the art. N-acyl, N-methyl glucamides, for example, are disclosed by J. W. Goodby, M. A. Marcus, E. Chin, and P. L. Finn in "The Thermotropic Liquid-Crystalline Properties of Some Straight Chain Carbohydrate Amphiphiles," *Liquid Crystals,* 1988, Volume 3, No. 11, pp 1569–1581, and by A. Muller-Fahrnow, V. Zabel, M. Steifa, and R. Hilgenfeld in "Molecular and Crystal Structure of a Nonionic Detergent: Nonanoyl-N-methylglucamide," J. *Chem. Soc. Chem. Commun.,* 1986, pp 1573–1574. The use of N-alkyl polyhydroxyamide surfactants has been of substantial interest recently for use in biochemistry, for example in the dissociation of biological membranes. See, for example, the journal article "N-D-Gluco-N-methyl-alkanamide Compounds, a New Class of Non-Ionic Detergents For Membrane Biochemistry," Biochem. J. (1982), Vol. 207, pp 363–366, by J. E. K. Hildreth.

The use of N-alkyl glucamides in detergent compositions has also been discussed. U.S. Pat. No. 2,965,576, issued Dec. 20, 1960 to E. R. Wilson, and G.B. Patent 809,060, published Feb. 18, 1959, assigned to Thomas Hedley & Co., Ltd. relate to detergent compositions containing anionic surfactants and certain amide surfactants, which can include N-methyl glucamide, added as a low temperature suds enhancing agent. These compounds include an N-acyl radical of a higher straight chain fatty acid having 10–14 carbon atoms. These compositions may also contain auxiliary materials such as alkali metal phosphates, alkali metal silicates, sulfates, and carbonates. It is also generally indicated that additional constituents to impart desirable properties to the composition can also be included in the compositions, such as fluorescent dyes, bleaching agents, perfumes, etc.

U.S. Pat. No. 2,703,798, issued Mar. 8, 1955 to A. M. Schwartz, relates to aqueous detergent compositions containing the condensation reaction product of N-alkyl glucamine and an aliphatic ester of a fatty acid. The product of this reaction is said to be useable in aqueous detergent compositions without further purification. It is also known to prepare a sulfuric ester of acylated glucamine as disclosed in U.S. Pat. No. 2,717,894, issued Sep. 13, 1955, to A. M. Schwartz.

PCT International Application WO 83/04412, published Dec. 22, 1983, by J. Hildreth, relates to amphiphilic compounds containing polyhydroxyl aliphatic groups said to be useful for a variety of purposes including use as surfactants in cosmetics, drugs, shampoos, lotions, and eye ointments, as emulsifiers and dispensing agents for medicines, and in biochemistry for solubilizing membranes, whole cells, or other tissue samples, and for preparation of liposomes. Included in this disclosure are compounds of the formula $R'CON(R)CH_2R''$ and $R''CON(R)R'$ wherein R is hydrogen or an organic grouping, R' is an aliphatic hydrocarbon group of at least three carbon atoms, and R'' is the residue of an aldose.

European Patent 0 285 768, published Oct. 12, 1988, H. Kelkenberg, et al, relates to the use of N-polyhydroxy alkyl fatty acid amides as thickening agents in aqueous detergent systems. Included are amides of the formula $R_1C(O)N(X)R_2$ wherein $R_1$ is a $C_1$–$C_{17}$ (preferably $C_7$–$C_{17}$) alkyl, $R_2$ is hydrogen, a $C_1$–$C_{18}$ (preferably $C_1$–$C_6$) alkyl, or an alkylene oxide, and X is a polyhydroxy alkyl having four to seven carbon atoms, e.g., N-methyl, coconut fatty acid glucamide. The thickening properties of the amides are indicated as being of particular use in liquid surfactant systems containing paraffin sulfonate, although the aqueous surfactant systems can contain other anionic surfactants, such as alkylaryl sulfonates, olefin sulfonate, sulfosuccinic acid half ester salts, and fatty alcohol ether sulfonates, and nonionic surfactants such as fatty alcohol polyglycol ether, alkylphenol polyglycol ether, fatty acid polyglycol ester, polypropylene oxide-polyethylene oxide mixed polymers, etc. Paraffin sulfonate/N-methyl coconut fatty acid glucamide/nonionic surfactant shampoo formulations are exemplified. In addition to thickening attributes, the N-polyhydroxy alkyl fatty acid amides are said to have superior skin tolerance attributes.

U.S. Pat. No. 2,982,737, issued May 2, 1961, to Boettner, et al, relates to detergent bars containing urea, sodium lauryl sulfate anionic surfactant, and an N-alkylglucamide nonionic surfactant which is selected from N-methyl,N-sorbityl lauramide and N-methyl, N-sorbityl myristamide.

Other glucamide surfactants are disclosed, for example, in DT 2,226,872, published Dec. 20, 1973, H. W. Eckert, et al, which relates to washing compositions comprising one or more surfactants and builder salts selected from polymeric phosphates, sequestering agents, and washing alkalis, improved by the addition of an N-acylpolyhydroxyalkyl-amine of the formula $R_1C(O)N(R_2)CH_2(CHOH)_nCH_2OH$, wherein $R_1$ is a $C_1$–$C_3$ alkyl, $R_2$ is a $C_{10}$–$C_{22}$ alkyl, and n is 3 or 4. The N-acylpolyhydroxyalkyl-amine is added as a soil suspending agent.

U.S. Pat. No. 3,654,166, issued Apr. 4, 1972, to H. W. Eckert, et al, relates to detergent compositions comprising at least one surfactant selected from the group of anionic, zwitterionic, and nonionic surfactants and, as a textile softener, an N-acyl, N-alkyl polyhydroxylalkyl compound of the formula $R_1N(Z)C(O)R_2$ wherein $R_1$ is a $C_{10}$–$C_{22}$ alkyl, $R_2$ is a $C_7$–$C_{21}$ alkyl, $R_1$ and $R_2$ total from 23 to 39 carbon atoms, and Z is a polyhydroxyalkyl which can be $—CH_2(CHOH)_mCH_2OH$ where m is 3 or 4.

U.S. Pat. No. 4,021,539, issued May 3, 1977, to H. Möller, et al, relates to skin treating cosmetic compositions containing N-polyhydroxylalkyl-amines which include compounds of the formula $R_1N(R)CH(CHOH)_mR_2$ wherein $R_1$ is H, lower alkyl, hydroxy-lower alkyl, or aminoalkyl, as well as heterocyclic aminoalkyl, R is the same as $R_1$ but both cannot be H, and $R_2$ is $CH_2OH$ or COOH.

French Patent 1,360,018, Apr. 26, 1963, assigned to Commercial Solvents Corporation, relates to solutions of formaldehyde stabilized against polymerization with the addition of amides of the formula $RC(O)N(R_1)G$ wherein R is a carboxylic acid functionality having at least seven carbon atoms, $R_1$ is hydrogen or a lower alkyl group, and G is a glycitol radical with at least 5 carbon atoms.

German Patent 1,261,861, Feb. 29, 1968, A. Heins, relates to glucamine derivatives useful as wetting and dispersing agents of the formula $N(R)(R_1)(R_2)$ wherein R is a sugar residue of glucamine, $R_1$ is a $C_{10}$–$C_{20}$ alkyl radical, and $R_2$ is a $C_1$–$C_5$ acyl radical.

G.B. Patent 745,036, published Feb. 15, 1956, assigned to Atlas Powder Company, relates to heterocyclic amides and carboxylic esters thereof that are said to be useful as chemical intermediates, emulsifiers, wetting and dispersing agents, detergents, textile softeners, etc. The compounds are expressed by the formula $N(R)(R_1)C(O)R_2$ wherein R is the residue of an anhydrized hexane pentol or a carboxylic acid ester thereof, $R_1$ is a monovalent hydrocarbon radical, and $—C(O)R_2$ is the acyl radical of a carboxylic acid having from 2 to 25 carbon atoms.

SUMMARY OF THE INVENTION

The present invention encompasses soap compositions in bar form, comprising:

(a) from about 75% to about 85% by weight of a substantially water-soluble, non-lithium fatty acid soap;

(b) from about 1% by weight of a polyhydroxy fatty acid amide surfactant; and (c) the balance of the bar is typically water and optional minor ingredients such as perfume, preservatives, and the like.

Typical soap bars herein comprise from about 75% to about 85% by weight of a $C_{12}$–$C_{18}$ soap in the sodium, potassium, ammonium, or alkanolammonium salt form; from about 1% to about 10% by weight of polyhydroxy fatty acid amide surfactant; and from about 8% to about 12% by weight of water. The preferred polyhydroxy fatty acid amide surfactant is a $C_{12}$–$C_{18}$ alkyl N-methyl glucamide, and the preferred fatty acid soap comprises the sodium salt of mixed $C_{12}$–$C_{18}$ fatty acids. Preferred bars according to this invention are characterized by a hardness value below about 3, more preferably below about 2, as measured by a "dry" (or, "as is") penetrometer test.

A highly preferred soap bar herein comprises:

(a) about 75% to 85% of a sodium soap having an I.V. in the range of from about 25 to about 35;

(b) about 3% of a $C_{12}$–$C_{18}$ N-methyl glucamide surfactant;

(c) about 0.3% to about 0.5% of NaCl; and (d) about 10% water, the balance comprising conventional soap bar minor ingredients, said bar being characterized by a hardness value from about 2 to about 2.5.

The invention also encompasses a method for improving the hardness qualities of soap bars comprising substantially watersoluble, non-lithium fatty acid soap wherein said bar contains from about 8% to about 12% by weight of water, but without substantial deleterious effect on the lather properties or tendency of said bars to crack on storage or use, by formulating said bars to comprise:

(a) from about 8% to about 12% of water;

(b) from about 75% to about 85% by weight of substantially water-soluble, non-lithium fatty acid-derived soap, said soap preferably having an Iodine Value in the range from about 25 to about 35;

(c) from about 1% to about 10% by weight of a polyhydroxy fatty acid amide surfactant;

(d) from about 0.2% to about 0.6% by weight of electrolyte; and (e) forming said stock into bar form by conventional processing techniques.

The bars herein can optionally also contain synthetic ("Syndet") non-soap, non-polyhydroxy fatty acid amide, detergents typically at levels from about 0% to about 30% of the bar, depending on the desires of the formulator.

All percentages, ratios and proportions herein are by weight, unless otherwise specified. The cited patents and articles mentioned herein are incorporated herein by reference.

DETAILED DESCRIPTION OF THE INVENTION

The soap bars of this invention are prepared using processes and equipment which are well-known and standard in the industry, and the manufacturing operations for forming the bars form no part of this invention. However, to assist the formulator the following description is provided by way of illustration and not by way of limitation of bar-making operations useful herein.

189 pounds (85.6 kg) of tallow fatty acid, 27 pounds (12.2 kg) of stearic acid, and 54 pounds (24.4 kg) coconut fatty acid are blended in a "crutcher" at a temperature of about 120° F. (49° C.). This crutcher is equipped with a standard turbine agitator and a recirculation loop to further improve mixing. The blend of fatty acid is then neutralized with NaOH solution. About 84 pounds (38 kg) of a 50% solution is needed to complete the neutralization. Prior to the addition of the caustic, 2.1 pounds (0.95 kg) of salt (NaCl) is added to the caustic solution. During neutralization the temperature rises to 180°-190° F. (82° to 88° C.).

After neutralization is completed, 9.78 pounds (4.4 kg) tallowalkyl N-methyl glucose amide in the form of powder is added to the neutralized mass keeping strong agitation so that good mixing results. The temperature is maintained at about 180° F. (82° C.). After the tallowalkyl N-methyl glucamide addition, about 15 minutes of agitation is enough to provide good mixing.

The resulting mixture contains about 30% moisture. The mixture is then dried to 10.5% moisture in a vacuum flash dryer under the following operating conditions:

temperature before heat exchanger = 180° F. (82° C.)
temperature after heat exchanger = 220° F. (104° C.)
temperature of dried product noodles = 120° F. (49° C.)
vacuum chamber pressure = 40 mmHg The dried product noodles are then processed into bars using standard process equipment: premilling, amalgamator, milling, plodding, and stamping. Bars made in this manner can exhibit hardness grades ("dry") of about 2, by the penetrometer Test 1 described hereinafter.

The following procedures can be used to measure the physical parameters of the bars of this invention.

Hardness Test Procedure—The hardness of the bars prepared herein can be measured by the following procedure. In general, bars having a hardness value in the range below about 3, preferably below about 2, in the first Test (Test 1) listed give good consumer value, acceptable smear, and the like. The first Test listed involves "pin" penetration of the "dry" bar, i.e., without contacting the bar with additional moisture other than the, roughly, 10% water present in the bar. In an alternate Test (Test 2; also shown below) the bar is first moistened. In the second Test procedure, penetration of a "ball" is used, and in this type of Test penetration scores below about 1.25, more preferably below about 1.0, are desirable.

Test 1

Bar Penetrometer Test

Equipment:

Precision penetrometer 1/10 millimeter division instrument. (Model 1- Meter 538 Fisher Scientific)
Cone penetrometer (12.79 g)
230.6 g weight
Kodak timer Method:

Place bar under the penetrometer cone with the bar resting on a wood slab. Cover the bar with thin wax paper.
Lower the metal penetrating cone unit until the point of the cone touches the surface of the paper. (Place paper between bar and cone and lower cone to the point where the paper can be removed without tearing.)
Remove the sheet of paper.
Cone has a 230.66 g weight on top of the cone shaft.
Press cone release lever; hold for 10 seconds; release; raise cone arm; move to new point on bar surface; repeat process.
Repeat three times forming a triangle on the bar with the three penetrating points.
Push top shaft button down to obtain a dial reading for penetrometer depth division = 1/10 millimeters.
The reading will be an accumulative sum of the three penetrations.
Divide by three to obtain an average penetrometer reading. Then divide by 10 to give a reading in millimeters, and report the hardness value (in millimeters).

Test 2

Ball Penetrometer Test/100 ML Smear

Equipment:

Precision penetrometer 1/10 millimeter divisions instrument. (Model 1- Meter 538 Fisher Scientific)
Ball penetrometer (11.40 g)
300.6 g weight
Petri dishes, 90 mm inside, 22 mm deep
Standard plastic perch (soap dish style; bar barely touching the water)
Graduated cylinder or dispensing flask.

Method

Place bar centrally on plastic perch in a petri dish.
Take bars to the 80/80 (80° F./80% relative humidity) room and add 100 mls of distilled water. Store bars (overnight) in the 80/80 room.
Next morning bring bars back to the lab. Gently remove bar from petri dish, place wet side up under penetrometer ball.
Lower the metal penetrating ball so that it just touches the surface of the bar.

Ball has a 300.6 g weight on top of shaft.

For curved bars, hold the bar securely while conducting measurements.

Press release lever, hold for 10 seconds, release, raise ball arm, wipe excess gel off ball, move ball to new point on bar surface, repeat process.

Do this three times. For curved bar, make three points across the arc of the bar. For brick shape make a triangle.

Push top shaft button down to obtain a dial reading for penetrometer depth division = 1/10 millimeter.

The reading will be an accumulative sum of the penetrations.

Divide by three to obtain an average penetrometer reading. Then divide by 10 to give a reading in millimeters, and report the hardness value (in millimeters.)

The ingredients used in the practice of this invention are known materials, and the ingredients per se and their individual methods of manufacture form no part of this invention. Rather, it is the combination of these ingredients to provide the compositions disclosed herein to achieve the desirable results that constitutes the invention herein. However, the ingredients are described below in order to assist the formulator.

Soaps—The soap ingredient herein is the well-known article of commerce, comprising the substantially water-soluble salts of fatty acids, typically $C_{12}$–$C_{18}$ fatty acids. Such salts include the alkali, ammonium, alkanolammonium salts, and the like. Sodium salts, potassium salts, triethanolammonium, ammonium, and the like, salts are mentioned here by way of exemplification and not not by way of limitation. (Non-water soluble soaps, especially lithium soaps, as well as insoluble calcium and magnesium soaps, are not used as the "soap" component of the bars of this invention.) Fatty acids are available by synthetic processes, or, more typically, by base hydrolysis of fats and oils such as lard, palm oil, tallow, coconut oil, and the like. Coconut, tallow and palm oil fatty acids are mentioned by way of exemplification, but not limitation of fatty acid sources for typical soaps. Mixtures of fatty acids derived from various sources can be used. In a preferred mode the soaps used herein have a relatively low degree of unsaturation, i.e., have a relatively low Iodine Value, preferably in the I.V. range of from about 25 to about 35. As is known in the art, low I.V. soaps can be prepared by hydrogenating fatty soap feedstocks, or by blending soap feedstocks with saturated fatty acids to lower the overall I.V. of the feedstock. For example, soaps prepared from the mixed tallow/stearic/coconut fatty acids noted hereinafter yield a very desirable bar, but this can be varied according to the desires, objectives and raw material resources of the formulator.

Water—The water content of the bars herein is at least about 8% and typically ranges from about 8 to about 15, preferably, about 10% by weight, of the finished bar. The amount of water used by the formulator will depend on the softness of the bar that the formulator and user might find acceptable, the chain length of the fatty acid soaps, the amount of polyhydroxy fatty acid amide used in the bar, and the like. Such matters can be adjusted, as a matter of routine.

Electrolytes—The bar herein will optionally, but preferably, contain an electrolyte. Electrolytes are commonly added to soap bars to cause the soap to be in the form of what is commonly referred to as "neat" phase. The selection of electrolytes for use in soap bars is a matter of discretion of the formulator, but typical, inexpensive, water-soluble toxicologically-acceptable electrolytes include a wide variety of organic or, more typically, inorganic salts such as alkali metal halides, sulfates, phosphates, and the like. Among such materials there can be mentioned solely by way of exemplification and not by way of limitation: sodium chloride (preferred), potassium chloride, sodium sulfate, sodium phosphate, and the like. Typically, the electrolyte need not comprise more than about 2%, and more preferably comprises from about 0.2% to about 0.6%, by weight of the bar.

Optionals—The bars herein can optionally contain various additional ingredients of the type typically used in toilet and cosmetic bars. Various ingredients which can be mentioned by way of exemplification, but not by way of limitation, include: perfumes; opacifiers; pearlescent agents; antibacterials; dyes; "super-fatting" agents such as glycerin; abrasives such as pumice; and the like. Such ingredients can typically range from about 0.1% to about 15% by weight of the bars, depending on the objectives of the formulator.

One additional type of optional ingredient used in the bars herein includes the synthetic detergents such as the sulfated and sulfonated Of $C_{12}$–$C_{18}$ alcohols, alkyl benzene, and the like. Nonionic synthetic detergents such as the $C_{12}$–$C_{18}$ polyethoxylates, $C_{12}$–$C_{18}$ alkyl phosphates, zwitterionics, cationics, amine oxides, and the like, can be used. Such synthetic detergents are well-known, and reference can be made to McCutcheon's Index or other texts for standard listings. If used, such syndets conveniently comprise about 2% to about 15% by weight of the bar.

Polyhydroxy Fatty Acid Amide Surfactants—These materials are also known in the literature, along with various methods for their synthesis. (See, for example, the references cited in the Background Art, above.) However, to further assist the formulator, the following provides examples of convenient, but nonlimiting, syntheses of such polyhydroxy fatty acid amide surfactants for use herein.

The reaction for the preparation of the polyhydroxyamines which are used to prepare the polyhydroxy fatty acid amide surfactants employed herein can be termed the "R-1" reaction, and is illustrated by the formation of N-methylglucamine, wherein $R^1$ is methyl.

$$R^1NH_2 + \text{glucose} \xrightarrow{CH_3NH_2(xs)} \text{Adduct} + H_2O$$

$$\text{Adduct} + H_2 \xrightarrow{\text{catalyst}} R^1N(H)CH_2(CHOH)_4CH_2OH$$

The reactants, solvents and catalysts used in the R-1 reaction are all well-known materials which are routinely available from a variety of commercial sources. The following are nonlimiting examples of materials which can be used herein.

Amine Material—The amines useful in the R-1 reaction herein are primary amines of the formula $R^1NH_2$, wherein $R^1$ is, for example, alkyl, especially $C_1$–$C_4$ alkyl, or $C_1$–$C_4$ hydroxyalkyl. Examples include methyl, ethyl, propyl, hydroxyethyl, and the like. Nonlimiting examples of amines useful herein include methyl amine, ethyl amine, propyl amine, butyl amine, 2-hydroxypropyl amine, 2-hydroxyethyl amine; methyl amine is preferred. All such amines are sometimes jointly referred to as "N-alkyl amines".

Polyhydroxy Material—A preferred source of polyhydroxy materials useful in the R-1 reaction comprises reducing sugars or reducing sugar derivatives. More specifically, reducing sugars useful herein include glucose (preferred), maltose, fructose, maltotriose, xylose, galactose, lactose, and mixtures thereof.

Catalyst—A variety of hydrogenation catalysts can be used in the R-1 reaction. Included among such catalysts are nickel (preferred), platinum, palladium, iron, cobalt, tungsten, various hydrogenation alloys, and the like. A highly preferred catalyst herein comprises "United Catalyst G49B" a particulate Ni catalyst supported on silica, available from United Catalysts, Inc., Louisville, Ky.

Solvent—Formation of the adduct in the R-1 process is carried out using an excess of the amine as the solvent. The excess amine also is used in the subsequent reaction with hydrogen. Optionally, the amine can be replaced with an alcohol, such as methanol, for the hydrogen reaction. Typical examples of solvents useful herein in the formation of the amine-sugar adduct include methyl amine, ethyl amine, and hydroxyethyl amine; methyl amine is preferred; methyl amine/water solvent can also be used.

General R-1 Reaction Conditions—Reaction conditions for the R-1 reaction are as follows.

(a) Adduct formation—The reaction time used for adduct formation will typically be on the order of 0.5–20 hours, depending somewhat on the reaction temperature chosen. In general, lower reaction temperatures in the range of 0° C.–80° C. require longer reaction times, and vice-versa. In general, over the preferred 30° C.–60° C. reaction temperature range, good adduct yields are achieved in 1–10 hours. Generally good adduct formation is achieved at about a 4:1 to 30:1 mole ratio of amine:-sugar. Typical sugar reactant concentrations in the amine solvent are in the 10%–60% (wt.) range. Adduct formation can be carried out at atmospheric or superatmospheric (preferred) pressures.

(b) Reaction with Hydrogen—The reaction with hydrogen can typically be run, for example, at temperatures of 40° C.–120° C. at 50–1,000 psi or, for example, at 50° C.–90° C. at 100–500 psi for periods of 0.1–35 hours, generally 0.5–8 hours, typically 1–3 hours. The adduct/solvent solution used in the hydrogen reaction is typically at a 10%-60% (wt.) solute level. (It will be appreciated that the selection of hydrogen reaction conditions will depend somewhat on the type of pressure equipment available to the formulator, so the above-noted reaction conditions can be varied without departing from this invention.) Hydrogen reaction catalyst levels are typically 1% to 40%, preferably about 2% to about 30% solids weight, calculated based on wt. catalyst:wt. reducing sugar substituent for batch processes. Of course, continuous processes could be run at much higher catalyst levels. The product of step (b) can be dried by solvent/water stripping, or by crystallization, trituration, or by means of effective drying agents.

EXAMPLE I

Anhydrous glucose (36.00 g; Aldrich Chemical Company) is weighed into a glass liner. The glass liner is placed into a dry-ice bath and methyl amine gas (68.00 g; Matheson) is condensed into the glass liner. The liner is then loaded into a rocking autoclave (500 ml capacity). The autoclave is heated to 50° C. and rocked for 5 hours at 50° C. under 600 psig nitrogen to form the adduct (N-methylglucosylamine). The reaction is then cooled in a dry-ice bath. The autoclave is then vented cold. Raney nickel (7.2 g of a 50% suspension in water, W/2 type, Aldrich Chemical Company) is added. The reaction is heated to 50° C. under 500–600 psig hydrogen and is rocked for 16 hours. The reaction is cooled in dry-ice bath and vented and purged with nitrogen. The reaction solution is pressure filtered through a Zeofluor filter (PTFE, 47 mm, 0.5 micron filter) with a 4 inch bed of Celite 545 (Fisher Scientific Company). The filtrate is concentrated under a stream of nitrogen to give 8.9 g of white solid. The Celite plug is washed with about 300 mls of water and the water is stripped on a rotary evaporator to give 18.77 g of white solid. The two solids are combined as they are analyzed to be of similar composition (90+ purity by GC analysis). The product is N-methyl glucamine.

EXAMPLE II

The process of Example I is repeated in a stirred autoclave fitted with a fritted exit filter, a triple impeller stirrer, outlet and inlet tubes and a baffle. Reagents and reaction conditions for the preparation of N-methyl glucamine are as follows: 15 g of 20% G49B catalyst (Ni/silica; United Catalyst) and 75 g glucose powder (Aldrich, Lot 07605LW) are slurried in 160 mls methanol and pretreated with $H_2$ for one hour (50° C.). The mixture is then cooled and the methanol is removed by pressure.

The reactor is cooled to less than 5° C. and charged with 76 mls of liquid methyl amine.

The reaction mixture is slowly heated to 60° C. over 46 minutes at 250 psi hydrogen and sampled. Heating is continued at 60° C. for 20 minutes and sample 2 is taken. Heating is continued at 60° C. for 46 minutes (sample 3) and then at 60° C. for 17 minutes (sample 4). The reaction mix is heated to 70° C. for an additional 33 minutes (sample 5). Total reaction time is 2.7 hours. The dried product is 93.2% N-methyl glucamine (GC analysis).

The polyhydroxyamine products of the aforesaid R-1 reaction, preferably with water substantially removed, are desirable and can be further employed in an amide-forming reaction which is designated herein as the "R-2" reaction. A typical R-2 amide-forming reaction herein can be illustrated by the formation of lauroyl N-methyl glucamide, as follows.

$$R^2COOMe + MeN(H)CH_2(CHOH)_4CH_2OH \xrightarrow[\text{methoxide}]{\text{methanol}} R^2C(O)N(Me)CH_2(CHOH)_4CH_2OH + MeOH$$

wherein $R^2$ is $C_{11}H_{23}$ alkyl.

Thus, an overall reaction for preparing polyhydroxy fatty acid amide surfactants comprises:

(a) reacting a reducing sugar (preferably glucose) or reducing sugar derivative with an amine reactant (preferably methyl amine) in an amine solvent (preferably, methyl amine) to provide an adduct;

(b) reacting said adduct from step (a) dissolved in said amine solvent with hydrogen in the presence of a metal catalyst;

(c) removing said catalyst and substantially removing water and excess amine solvent from the reaction mixture to provide the polyhydroxyamine reaction product; and, thereafter, per the R-2 process;

(d) reacting said substantially anhydrous polyhydroxyamine product from step (c) with a fatty acid ester in an organic hydroxy sol vent (preferably, methanol or propylene glycol) in the presence of a base catalyst to form the polyhydroxy fatty acid amide surfactant (preferably, at a temperature below about 100° C.); and (e) optionally, when the reaction step (d) is essentially complete, removing said solvent used in step (d).

More specifically, the combination of R-1 and R-2 reactions herein provides an overall process (R-1 plus R-2) which can be used to prepare polyhydroxy fatty acid amide surfactants for use herein having the formula:

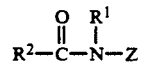

(I)

wherein: $R^1$ is H, $C_1$–$C_4$ hydrocarbyl, 2-hydroxyethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl moiety having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl moiety. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic mono- or poly- saccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-isobutyl, N-2-hydroxy ethyl, or N-2-hydroxy propyl.

$R^2$-CO-N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

The following reactants, catalysts and solvents can conveniently be used in the R-2 reaction herein, and are listed only by way of exemplification and not by way of limitation. Such materials are all well-known and are routinely available from a variety of commercial sources.

Reactants—Various fatty esters can be used in the R-2 reaction, including mono-, di- and triesters (i.e., triglycerides). Methyl esters, ethyl esters, and the like are all quite suitable. The polyhydroxyamine reactants include reactants available from the above-described R-1 reaction, such as N-alkyl and N-hydroxyalkyl polyhydroxyamines with the N-substituent group such as $CH_3$—, $C_2H_5$—, $C_3H_7$—, $HOCH_2CH_2$—, and the like. (Polyhydroxyamines available from the R-1 reaction are preferably not contaminated by the presence of residual amounts of metallo hydrogenation catalysts, although a few parts per million [e.g., 1–20 ppm] can be present.) Mixtures of the ester and mixtures of the polyhydroxyamine reactants can also be used.

Catalysts—The catalysts used in the R-2 reaction are basic materials such as the alkoxides (preferred), hydroxides (less preferred due to possible hydrolysis reactions), carbonates, and the like. Preferred alkoxide catalysts include the alkali metal $C_1$–$C_4$ alkoxides such as sodium methoxide, potassium ethoxide, and the like. The catalysts can be prepared separately from the reaction mixture, or can be generated in situ using an alkali metal such as sodium. For in situ generation, e.g., sodium metal in the methanol solvent, it is preferred that the other reactants not be present until catalyst generation is complete. The catalyst typically is used at a level of about 5 mole % of the ester reactant. Mixtures of catalysts can also be used.

Solvents—The organic hydroxy solvents used in the R-2 reaction include, for example, methanol, ethanol, propanol, iso-propanol, the butanols, glycerol, 1,2-propylene glycol, 1,3-propylene glycol, and the like. Methanol is a preferred alcohol solvent and 1,2-propylene glycol is a preferred diol solvent. Mixtures of solvents can also be used.

General R-2 Reaction Conditions—It is preferred to prepare the desired products while minimizing the formation of cyclized by-products, ester amides and color bodies. Reaction temperatures below about 135° C., typically in the range of from about 40° C. to about 100° C., preferably 50° C. to 80° C., are used to achieve this objective, especially in batch processes where reaction times are typically on the order of about 0.5–2 hours, or even up to 6 hours. Somewhat higher temperatures can be tolerated in continuous processes, where residence times can be shorter.

The following examples are intended to illustrate the practice of the R-2 reaction using the N-polyhydroxyamines prepared by the above-disclosed R-1 reaction (with $H_2O$ having been substantially removed), but are not intended to be limiting thereof. It is pointed out that the concentration ranges of the reactants and solvent in Example III provide what can be termed a "70% concentrated" (with respect to reactants) reaction mixture. This 70% concentrated mixture provides good results, in that high yields of the desired polyhydroxy fatty acid amide product are secured rapidly. Indeed, indications are that the reaction is substantially complete within one hour, or less. The consistency of the reaction mixture at the 70% concentration level provides ease of handling. However, even better results are secured at the 80% and 90% concentration levels, in that chromotography data indicate that even less of the undesired by-products are formed at these higher concentrations. At the higher concentrations the reaction systems are somewhat more difficult to work with, and require more efficient stirring (due to their initial thickness), and the like, at least in the early stages of the reaction. Once the reaction proceeds to any appreciable extent, the viscosity of the reaction system decreases and ease of mixing increases.

EXAMPLE III

The product of Example I (9.00 g, 0.0461 moles, N-methylglucamine) is combined with 8.22 g methanol anhydrous in a round bottom flask fitted with condenser, drying tube and argon blanket. The reaction methanol and N-methylglucamine are heated to reflux for 15 minutes. Sodium methoxide (0.1245 g, 0.0023 moles, Aldrich Chemical Company) and methyl ester (10.18 g, 0.0461 moles, Procter & Gamble CE1270, includes $C_{12}$–$C_{18}$ fatty acid esters) are added and reaction continued at reflux for 3 hours. Methanol is then removed under reduced pressure to give essentially colorless white product. Yields are not reported since samples were taken during reaction at 30 minutes, 1 hour, 2 hours and 3 hours before drying. The dried sample is washed with cold methanol and filtered and final drying is done under vacuum to give 10.99 g of the polyhydroxy fatty acid amide surfactant.

EXAMPLE IV

An overall process at the 80% reactant concentration level for the amide synthesis is as follows.

A reaction mixture consisting of 84.87 g. fatty acid methyl ester (source: Procter & Gamble methyl ester CE1270), 75 g. N-methylglucamine per Example I, above, 1.04 g. sodium methoxide and a total of 39.96 g. methyl alcohol (ca. 20% by wt. of reaction mixture) is used. The reaction vessel comprises a standard reflux set-up fitted with a drying tube, condenser and mechanical stirring blade. The N-methyl glucamine/methanol is heated with stirring under argon (reflux). After the solution has reached the desired temperature, the ester and sodium methoxide catalyst are added. The reaction mixture is maintained at reflux for 6 hours. The reaction is essentially complete in 1.5 hours. After removal of the methanol, the recovered product weighs 105.57 grams. Chromatography indicates the presence of only traces of undesired ester-amide by-products, and no detectable cyclized by-product.

EXAMPLE V

The process of Example IV is repeated at the 90% reactant level for the polyhydroxy fatty acid amide synthesis step. Levels of undesirable by-products are extremely low, and reaction is essentially complete at 30 minutes. In an alternate mode, the reaction can be initiated at a 70% reactant concentration, for example, and methanol can be stripped during the course of the reaction and the reaction taken to completion.

EXAMPLE VI

The process of Example III is repeated in ethanol (99%) and 1,2-propylene glycol (essentially dry), respectively, with good product formation. In an alternate mode, a solvent such as 1,2-propylene glycol is used in the R-2 step, with methanol stripping throughout the process. The resulting surfactant/glycol mix can be used directly in a detergent composition.

Having thus disclosed reaction conditions involving amine solvents in the R-1 step of the instant process, it has further been determined that mixtures of amine/water solvents for use in R-1 affords still additional advantages in the R-1 reaction. In particular, the use of an amine/water solvent: yields substantially no color formation in the reaction products; gives high product yields relatively quickly; and leaves essentially no reducing sugars in the reaction product, which can contribute to color formation in the subsequent R-2 reaction. The R-1 reaction in a mixed amine/water solvent is as follows.

EXAMPLE VII

Using a stirred autoclave and procedure per Example II, 15 g of the 649B catalyst, glucose powder (75 g; Aldrich) and 160 mls methanol are slurried and treated with $H_2$ to remove oxide from the catalyst surface. Methanol is removed. 80 mls (52.8 g) of methyl amine are added to the glucose/catalyst mixture at below 5° C., and 22 mls water are added at room temperature.

The reaction mixture is heated to 70° C. in 34 minutes and held at 70° C. for 40 minutes, during the hydrogenation. The $H_2O$/methyl amine solution of the reaction product is blown out of the reactor through the frit (removes catalyst) and dried to yield the N-methylglucamine product.

When using the mixed amine/water solvent, weight ratios of amine (especially, methyl amine) and water in a range of from about 10:1 to about 1:1 are typically employed. The R-1 reaction product, substantially free from water (preferably, less than about 1%, more preferably, less than about 0.3% by weight of water) can then be used in the R-2 reaction to prepare polyhydroxy fatty acid amides, as described above.

While the foregoing disclosure generally relates to a solvent-assisted method for preparing N-methyl polyhydroxy amines, such as N-methyl glucamine, as well as their fatty acid amide derivatives using fatty methyl esters, it is to be understood that variations are available. Thus, reducing sugars such as fructose, galactose, mannose, maltose and lactose, as well as sugar sources such as high dextrose corn syrup, high fructose corn syrup and high maltose corn syrup, and the like, can be used to prepare the polyhydroxyamine material (i.e., to replace glucamine) of the reaction. Likewise, a wide variety of fats and oils (triglycerides) can be used herein in place of the fatty esters exemplified above. For example, fats and oils such as soybean oil, cottonseed oil, sunflower oil, tallow, lard, safflower oil, corn oil, canola oil, peanut oil, fish oil, rapeseed oil, and the like, or hardened (hydrogenated) forms thereof, can be used as the source of triglyceride esters for use in the present process. The present process is particularly useful when preparing the longer-chain (e.g., $C_{18}$) and unsaturated fatty acid polyhydroxy amides, since the relatively mild reaction temperatures and conditions herein afford the desired products with minimal by-product formation. A preformed portion of the polyhydroxy fatty acid amide surfactant can be used to assist initiation of the R-2 amide-forming reaction when triglycerides or the longer-chain methyl esters are used as reactants. Furthermore, use of propylene glycol, or glycerine, or preformed mono esters thereof, can assist in initiation of the R-2 reaction, as well. Surfactant yields in the R-2 process can be increased by simply storing the solidified product (which contains some minor amount of entrained solvent and reactants) e.g., at 50° C., for a few hours after removal from the reaction vessel. Storage in this manner apparently allows the last fraction of unreacted starting materials to continue to form the desired polyhydroxy fatty acid amide surfactant. Thus, yields can be increased appreciably, i.e., to a high degree of completion, which is an important consideration in large-scale industrial processes.

The following illustrates the use of the above-described surfactant products of the overall R-1 plus R-2 process to prepare bar soap compositions in the manner of this invention. These examples are not intended to be limiting, since a wide variety of surfactants, perfumes and optional other ingredients well-known to bar soap formulators can optionally be used in such compositions, all at conventional usage levels.

EXAMPLE VIII

A typical soap bar composition is as follows.

A typical soap bar composition is as follows.

| Ingredient | Percent (wt.) |
|---|---|
| Fatty acid soap* | 83.75 |
| Alkyl glucamide** | 3.00 |
| NaCl | 0.44 |
| Minors (perfumes, etc.) | 2.5 |
| Water | Balance |
| pH | 10.25 |

*Sodium salts of mixed tallow/stearic/coconut fatty acids at a weight ratio of 70/10/20.

**Mixed tallow alkyl N-methylglucamide prepared in the manner of Example III; tallow chain alkyl groups in the $C_{12}$-$C_{18}$ range.

EXAMPLE IX

The bar of Example VIII is modified by reducing the soap level to 76% and increasing the alkyl glucamide (made per Example IV) level to 10%. A softer bar is thereby secured.

EXAMPLE X

The bar of Example VIII is modified by increasing the soap level to 85% and decreasing the alkyl glucamide surfactant level to 2%. A harder bar is thereby secured.

EXAMPLE XI

A soap/syndet mixed bar is as follows.

A soap/syndet mixed bar is as follows.

| Ingredient | Percent (wt.) |
|---|---|
| Fatty acid soap* | 78.0 |
| Syndet** | 6.0 |
| Glucamide*** | 8.0 |
| NaCl/KCl (1:1 wt.) | 0.38 |
| Water | Balance |

*1:1 (wt.) mixed Na/K coconut soap.

**Mixed $C_{14-18}$ alkyl sulfate, sodium salt.

***Mixed $C_{12}$-$C_{18}$ alkyl N-methyl glucamide, prepared as disclosed above in Example V.

What is claimed is:

1. A soap composition in bar form, consisting essentially of:
   (a) from about 75% to about 85% by weight of a substantially water-soluble non-lithium mixed $C_{12}$-$C_{18}$ fatty acid soap;
   (b) at least about 1% by weight of a polyhydroxy fatty acid amide surfactant of the formula wherein $R^1$ is $C_1$-$C_4$ hydrocarbyl, $R^2$ is $C_{11}$-$C_{17}$ alkyl or alkenyl and Z is 1-deoxyglucityl or 2-deoxyfructityl; and
   (c) the balance comprising water and optional minor ingredients.

2. A bar according to claim 1 wherein the fatty acid soap comprises the sodium salt of mixed $C_{12}$-$C_{18}$ fatty acids.

* * * * *